US010612506B2

(12) United States Patent
Thomas et al.

(10) Patent No.: US 10,612,506 B2
(45) Date of Patent: Apr. 7, 2020

(54) METHOD AND SYSTEM FOR AN ENGINE

(71) Applicant: Ford Global Technologies, LLC, Dearborn, MI (US)

(72) Inventors: Joseph Thomas, Holt, MI (US); Ethan Sanborn, Saline, MI (US); Paul Hollar, Belleville, MI (US); Daniel Dusa, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 61 days.

(21) Appl. No.: 15/865,064

(22) Filed: Jan. 8, 2018

(65) Prior Publication Data

US 2019/0211787 A1 Jul. 11, 2019

(51) Int. Cl.

| | |
|---|---|
| ***F02M 55/00*** | (2006.01) |
| ***F02D 41/38*** | (2006.01) |
| ***F02D 41/40*** | (2006.01) |
| ***F02N 19/00*** | (2010.01) |
| *F02M 61/14* | (2006.01) |
| *F02N 11/08* | (2006.01) |

(52) U.S. Cl.

CPC ..... *F02M 55/007* (2013.01); *F02D 41/3809* (2013.01); *F02D 41/40* (2013.01); *F02N 19/004* (2013.01); *F02D 2041/389* (2013.01); *F02M 61/14* (2013.01); *F02N 11/0814* (2013.01); *F02N 11/0862* (2013.01); *F02N 2200/021* (2013.01)

(58) Field of Classification Search

CPC ..... F02D 41/40; F02M 5/00; F02M 5/007; F02N 19/00; F02N 19/004

USPC ..... 123/179.3–179.5, 179.14; 701/102, 113, 701/114

See application file for complete search history.

(56) References Cited

U.S. PATENT DOCUMENTS

| | | | | |
|---|---|---|---|---|
| 6,351,956 | B1 * | 3/2002 | Chen | B60H 1/3225 62/133 |
| 6,801,842 | B2 * | 10/2004 | Egami | B60H 1/3222 290/40 A |
| 7,370,613 | B2 * | 5/2008 | Lawrence | F02D 15/02 123/48 B |
| 8,899,203 | B2 | 12/2014 | Thomas | |
| 9,416,745 | B2 * | 8/2016 | Hiyoshi | F02D 41/123 |

* cited by examiner

*Primary Examiner* — John Kwon
*Assistant Examiner* — Johnny H Hoang
(74) *Attorney, Agent, or Firm* — Geoffrey Brumbaugh; McCoy Russell LLP

(57) ABSTRACT

Methods and systems are provided for relieving pressure from a compression locked engine. The engine may be compression locked during an engine start attempt due to operator application of a manual transmission clutch at or around the time of a first combustion event of the engine start. A direct injector of the compression locked cylinder is commanded open to relieve the pressure into the fuel rail.

7 Claims, 4 Drawing Sheets

METHOD AND SYSTEM FOR AN ENGINE

FIELD

The present description relates generally to methods and systems for controlling direct fuel injection in an engine cylinder to provide compression pressure relief.

BACKGROUND/SUMMARY

Vehicles may be configured with a manual transmission wherein a driver-operated clutch is engaged and disengaged by actuation of a foot pedal. Clutch adjustments may regulate torque transfer from the vehicle's engine to the transmission along a driveline. The vehicle operator may manually select a transmission gear via a gear selector and clutch adjustments be used in concert with the gear selection.

However, it is possible to compression lock an engine with a manual transmission. For example, during an engine start event, a cylinder is selected to be the first cylinder that receives both fuel and spark. Typically, the spark is scheduled to happen ~10-15 degrees before cylinder top dead center (TDC). If the operator of the vehicle disengages the clutch at the moment of spark delivery, the torque produced by the firing cylinder may not be capable of moving the vehicle. As a result, the combustion pressure may force the engine to rotate backwards and the engine may stall. In addition, the combustion pressure may be trapped within the cylinder. Since the starter motor is not designed to overcome this large pressure, the engine may be locked until the combustion pressure leaks past the cylinder rings. This may take a significant amount of time, causing delays before an engine start can be attempted again. Delays in engine start time may cause operator frustration and degrade the vehicle's drive performance.

The issues described above may be addressed by a method for providing compression pressure relief from a locked engine. One example approach includes cranking an engine; and responsive to engine locking following the cranking, commanding a direct fuel injector of a cylinder open to relieve cylinder pressure into a high pressure fuel rail via the open direct fuel injector. In this way, a direct fuel injector may be used for compression pressure relief, allowing for a subsequent engine start to be attempted earlier.

As one example, during an engine start event, while the engine is being cranked, the output of a crankshaft position sensor may be monitored. If the sensor indicates that engine rotation is initially detected but then the rotation stops due to a change in state of a clutch pedal of a manual transmission, it may be inferred that the engine is compression locked. The compression pressure may then be relieved by commanding the direct injection fuel injector of the cylinder that just combusted (and is still before TDC) to open. The cylinder's compression pressure is then relieved via the injector into the high-pressure fuel rail. The air from the cylinder will dissolve into the fuel in the fuel rail and will be gradually expelled over the next several injection events. One or more fuel injection adjustments may be performed over those several injection events to account for the added air in the delivered fuel.

In this way, existing engine hardware may be advantageously used to relieve cylinder compression pressure. The technical effect of commanding open a cylinder direct injection fuel injector responsive to an engine being compression locked during cranking is that the pressure may be rapidly relieved, enabling an engine start to be reattempted soon afterwards. By selecting the cylinder whose direct injector is commanded open based on a spark timing of the cylinder relative to a timing of clutch application (following which the engine became compression locked), adjustments to a single cylinder can be used to unlock the engine. By reducing the compression pressure and expediting unlocking of the engine, operator frustration due to poor engine startability is reduced. Overall, performance of an engine configured with a manual transmission is improved.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
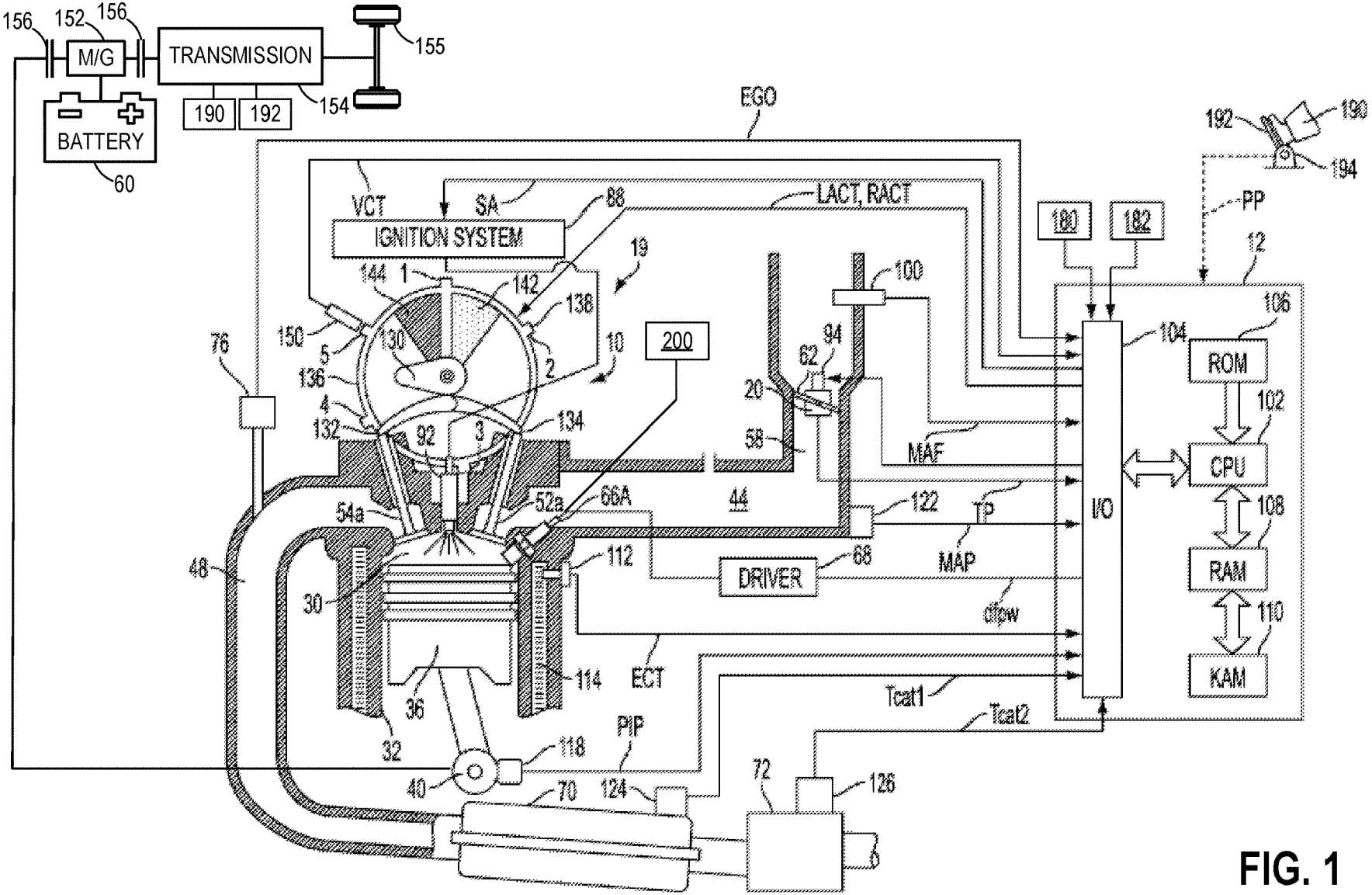
FIG. 1 shows an example engine cylinder system.

Methods and systems are provided for mitigating compression locking in an engine, such as the engine system of FIG. 1. The engine system may be configured with a fuel system that provides direct injected fuel to engine cylinders via a high pressure fuel rail pressurized by a high pressure pump. An engine controller may be configured to perform a control routine, such as the example routine of FIG. 3, to command a direct injector of a last firing cylinder open responsive to an aborted engine crank event. A prophetic example of relieving compression pressure via actuation of a direct injector is shown at FIG. 4.

FIG. 1 depicts an example embodiment of a combustion chamber or cylinder of internal combustion engine 10. FIG. 1 shows that engine 10 may receive control parameters from a control system including controller 12, as well as input from a vehicle operator 190 via an input device 192. In this example, input device 192 includes an accelerator pedal and a pedal position sensor 194 for generating a proportional pedal position signal PP. Engine 10 may be coupled in a vehicle system, such as in vehicle 5 configured for on-road propulsion.

Cylinder (herein also "combustion chamber") 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of the passenger vehicle via a transmission system. Further, a starter motor may be coupled to crankshaft 40 via a flywheel to enable a starting operation of engine 10. Housing 136 is hydraulically coupled to crankshaft 40 via a timing chain or belt (not shown).

Cylinder 30 can receive intake air via intake manifold or air passages 44. Intake air passage 44 can communicate with other cylinders of engine 10 in addition to cylinder 30. In some embodiments, one or more of the intake passages may include a boosting device such as a turbocharger or a supercharger. A throttle system including a throttle plate 62 may be provided along an intake passage of the engine for varying the flow rate and/or pressure of intake air provided to the engine cylinders. In this particular example, throttle plate 62 is coupled to electric motor 94 so that the position of elliptical throttle plate 62 is controlled by controller 12 via electric motor 94. This configuration may be referred to as electronic throttle control (ETC), which can also be utilized during idle speed control. The throttle system may include a throttle position sensor 20 coupled to throttle plate 62.

Combustion chamber 30 is shown communicating with intake manifold 44 and exhaust manifold 48 via respective intake valve 52*a* and 52*b* (not shown), and exhaust valves 54*a* and 5*b* (not shown). Thus, while four valves per cylinder may be used, in another example, a single intake and single exhaust valve per cylinder may also be used. In still another example, two intake valves and one exhaust valve per cylinder may be used.

Exhaust manifold 48 can receive exhaust gases from other cylinders of engine 10 in addition to cylinder 30. Exhaust gas sensor 76 is shown coupled to exhaust manifold 48 upstream of catalytic converter 70 (where sensor 76 can correspond to various different sensors). For example, sensor 76 may be any of many known sensors for providing an indication of exhaust gas air/fuel ratio such as a linear oxygen sensor, a UEGO, a two-state oxygen sensor, an EGO, a HEGO, or an HC or CO sensor. Emission control device 72 is shown positioned downstream of catalytic converter 70. Emission control device 72 may be a three-way catalyst, a NOx trap, various other emission control devices or combinations thereof.

In some embodiments, each cylinder of engine 10 may include a spark plug 92 for initiating combustion. Ignition system 88 can provide an ignition spark to combustion chamber 30 via spark plug 92 in response to spark advance signal SA from controller 12, under select operating modes. However, in some embodiments, spark plug 92 may be omitted, such as where engine 10 may initiate combustion by auto-ignition or by injection of fuel, as may be the case with some diesel engines.

In some embodiments, each cylinder of engine 10 may be configured with one or more fuel injectors for providing fuel thereto. As a non-limiting example, fuel injector 66A is shown coupled directly to cylinder 30 for injecting fuel directly therein in proportion to the pulse width of signal dfpw received from controller 12 via electronic driver 68. In this manner, fuel injector 66A provides what is known as direct injection (hereafter also referred to as "DI") of fuel into cylinder 30. The fuel injector may be mounted in the side of the combustion chamber (as shown) or in the top of the combustion chamber (near the spark plug), for example. Fuel may be delivered to fuel injector 66A by a fuel system 80 including a fuel tank, a fuel pump, and a fuel rail. Fuel system 80 is elaborated at FIG. 2. In some embodiments, combustion chamber 30 may alternatively or additionally include a fuel injector arranged in intake manifold 44 in a configuration that provides what is known as port injection of fuel into the intake port upstream of combustion chamber 30.

Controller 12 is shown as a microcomputer, including microprocessor unit 102, input/output ports 104, an electronic storage medium for executable programs and calibration values shown as read only memory chip 106 in this particular example, random access memory 108, keep alive memory 110, and a conventional data bus. Controller 12 is shown receiving various signals from sensors coupled to engine 10, in addition to those signals previously discussed, including measurement of inducted mass air flow (MAF) from mass air flow sensor 100 coupled to throttle 62; engine coolant temperature (ECT) from temperature sensor 112 coupled to cooling sleeve 114; a profile ignition pickup signal (PIP) from Hall effect sensor 118 coupled to crankshaft 40; and throttle position TP from throttle position sensor 20; absolute Manifold Pressure Signal MAP from sensor 122; an indication of knock from knock sensor 182; and an indication of absolute or relative ambient humidity from sensor 180. Engine speed signal RPM is generated by controller 12 from signal PIP in a conventional manner and manifold pressure signal MAP from a manifold pressure sensor provides an indication of vacuum, or pressure, in the intake manifold. During stoichiometric operation, this sensor can give an indication of engine load. Further, this sensor, along with engine speed, can provide an estimate of charge (including air) inducted into the cylinder. In one example, sensor 118, which is also used as an engine speed sensor, produces a predetermined number of equally spaced pulses every revolution of the crankshaft.

In this particular example, temperature Tcat1 of catalytic converter 70 is provided by temperature sensor 124 and temperature Tcat2 of emission control device 72 is provided by temperature sensor 126. In an alternate embodiment, temperature Tcat1 and temperature Tcat2 may be inferred from engine operation.

Continuing with FIG. 1, a variable camshaft timing (VCT) system 19 is shown. In this example, an overhead cam system is illustrated, although other approaches may be used. Specifically, camshaft 130 of engine 10 is shown communicating with rocker arms 132 and 134 for actuating intake valves 52*a*, 52*b* and exhaust valves 54*a*, 54*b*. In the depicted example, VCT system 19 is oil pressure actuated (OPA), wherein actuation of a camshaft phaser of the VCT system is enabled via oil pressure from oil flow through a spool valve. In alternate examples, VCT system 19 may be cam torque actuated (CTA) wherein actuation of the camshaft phaser is enabled via cam torque pulses. By adjusting a plurality of hydraulic valves to thereby direct a hydraulic fluid, specifically engine oil, into the cavity (such as an advance chamber or a retard chamber) of a camshaft phaser, valve timing may be changed, that is advanced or retarded.

Camshaft 130 is hydraulically coupled to housing 136. Housing 136 forms a toothed wheel having a plurality of teeth 138. In the example embodiment, housing 136 is mechanically coupled to crankshaft 40 via a timing chain or belt (not shown). Therefore, housing 136 and camshaft 130 rotate at a speed substantially equivalent to each other and synchronous to the crankshaft. In an alternate embodiment, as in a four stroke engine, for example, housing 136 and crankshaft 40 may be mechanically coupled to camshaft 130 such that housing 136 and crankshaft 40 may synchronously rotate at a speed different than camshaft 130 (e.g. a 2:1 ratio, where the crankshaft rotates at twice the speed of the camshaft). In the alternate embodiment, teeth 138 may be mechanically coupled to camshaft 130. By manipulation of the hydraulic coupling as described herein, the relative position of camshaft 130 to crankshaft 40 can be varied by hydraulic pressures in retard chamber 142 and advance chamber 144. By allowing high pressure hydraulic fluid to enter retard chamber 142, the relative relationship between camshaft 130 and crankshaft 40 is retarded. Thus, intake valves 52*a*, 52*b* and exhaust valves 54*a*, 54*b* open and close at a time later than normal relative to crankshaft 40. Similarly, by allowing high pressure hydraulic fluid to enter advance chamber 144, the relative relationship between camshaft 130 and crankshaft 40 is advanced. Thus, intake valves 52*a*, 52*b*, and exhaust valves 54*a*, 54*b* open and close at a time earlier than normal relative to crankshaft 40.

While this example shows a system in which the intake and exhaust valve timing are controlled concurrently, variable intake cam timing, variable exhaust cam timing, dual independent variable cam timing, dual equal variable cam timing, or other variable cam timing may be used. Further, variable valve lift may also be used. Further, camshaft profile switching may be used to provide different cam profiles under different operating conditions. Further still, the valve-train may be roller finger follower, direct acting mechanical bucket, electrohydraulic, or other alternatives to rocker arms.

Continuing with the variable cam timing system, teeth 138, rotating synchronously with camshaft 130, allow for measurement of relative cam position via cam timing sensor 150 providing signal VCT to controller 12. Teeth 1, 2, 3, and 4 may be used for measurement of cam timing and are equally spaced (for example, in a V-8 dual bank engine, spaced 90 degrees apart from one another) while tooth 5 may be used for cylinder identification. In addition, controller 12 sends control signals (LACT, RACT) to conventional solenoid valves (not shown) to control the flow of hydraulic fluid either into retard chamber 142, advance chamber 144, or neither.

Relative cam timing can be measured in a variety of ways. In general terms, the time, or rotation angle, between the rising edge of the PIP signal and receiving a signal from one of the plurality of teeth 138 on housing 136 gives a measure of the relative cam timing. For the particular example of a V-8 engine, with two cylinder banks and a five-toothed wheel, a measure of cam timing for a particular bank is received four times per revolution, with the extra signal used for cylinder identification.

A camshaft identification signal (CID) may be produced by a particular tooth or tooth pattern on wheel 136 as measured by sensor 150, which may be a Hall Effect sensor, variable reluctance sensor, or other sensor type. Likewise, crankshaft position sensor 118 may provide crankshaft position information (CPS) based on toothed wheel 136, which may have a plurality of teeth or teeth patterns, including a missing tooth position. Sensor 118 may be a Hall Effect sensor, variable reluctance sensor, or other sensor type. In an example aspect of the present description, engine position sensor 118 produces a predetermined number of equally spaced pulses every revolution of the crankshaft from which engine speed (RPM) can be determined.

As described in further detail below, based on the timing of receiving signals from sensor 118, the control system may identify engine position and/or the particular stroke of one or more cylinders (such as all of the cylinders) of the engine.

As described above, FIG. 1 merely shows one cylinder of a multi-cylinder engine, and that each cylinder has its own set of intake/exhaust valves, fuel injectors, spark plugs, etc.

The controller 12 receives signals from the various sensors of FIG. 1 and employs the various actuators of FIG. 1 to adjust engine operation based on the received signals and instructions stored on a memory of the controller. For example, based on torque demand as inferred based on input from the pedal position sensor, a fuel injection amount may be adjusted.

In some examples, vehicle 5 may be a hybrid-electric vehicle with multiple sources of torque available to one or more vehicle wheels 155. In other examples, vehicle 5 is a conventional vehicle with only an engine, or an electric vehicle with only electric machine(s). In the example shown, vehicle 5 includes engine 10 and an electric machine 152. Electric machine 152 may be a motor or a motor/generator. Crankshaft 40 of engine 10 and electric machine 152 are connected via a transmission 154 to vehicle wheels 55 when one or more clutches 156 are engaged. In the depicted example, a first clutch 156 is provided between crankshaft 140 and electric machine 152, and a second clutch 156 is provided between electric machine 152 and transmission 154. Controller 12 may send a signal to an actuator of each clutch 156 to engage or disengage the clutch, so as to connect or disconnect crankshaft 40 from electric machine 152 and the components connected thereto, and/or connect or disconnect electric machine 152 from transmission 154 and the components connected thereto. Transmission 154 may be a gearbox, a planetary gear system, or another type of transmission. The powertrain may be configured in various manners including as a parallel, a series, or a series-parallel hybrid vehicle.

Electric machine 152 receives electrical power from a traction battery 60 to provide torque to vehicle wheels 155. Electric machine 152 may also be operated as a generator to provide electrical power to charge battery 60, for example during a braking operation.

In the depicted example, transmission 154 is a manual transmission that clutch 156 is a driver-operated clutch that is engaged and disengaged by driver actuation of a foot pedal 190 for regulating torque transfer from the engine to the transmission. The driver may actuate the foot pedal in conjunction with manual actuation of a gear selector 192. A gear ratio of the transmission 154 may be provided based on the driver input received via the gear selector. The gear ratio may be provided by locking selected gear pairs to the output shaft inside the transmission based on the gear selection.

Based on the timing of clutch application in a manual transmission, it may be possible to compression lock the engine during an engine start. In addition to causing the initiated engine start to be aborted, the compression locking can cause delays before a subsequent engine start can be attempted. As elaborated at FIG. 3, compression pressure relief may be provided by commanding a direct injector of a selected cylinder open, thereby mitigating the compression locking of the engine.

Figure 2:
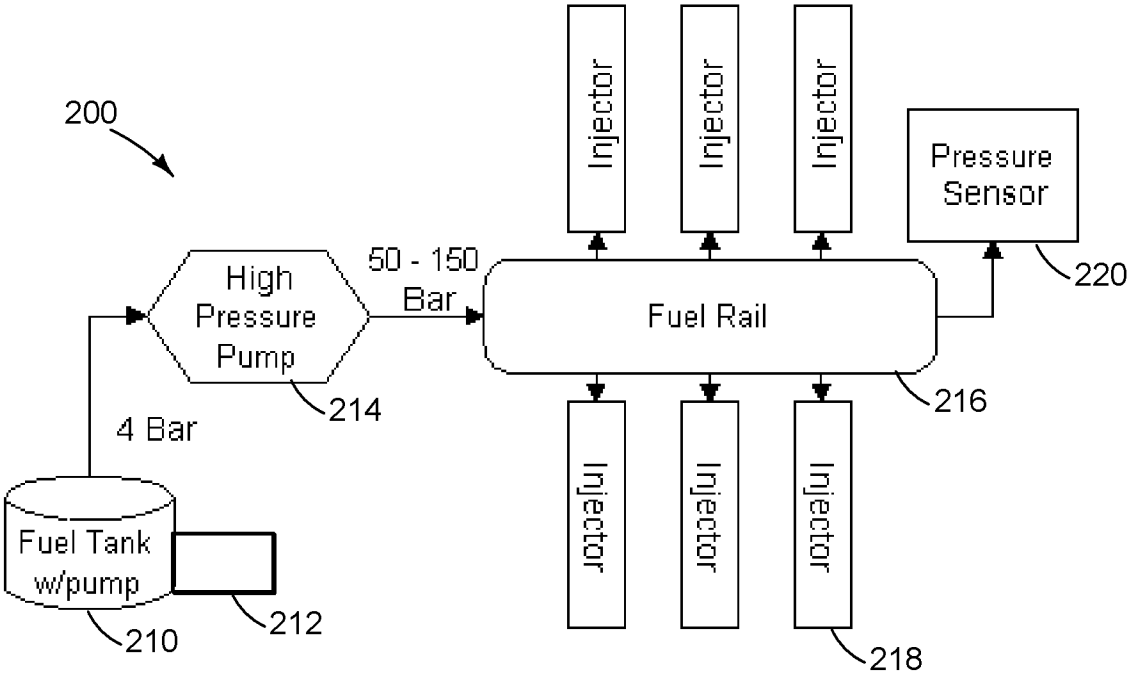
FIG. 2 shows an example fuel system.

Referring now to FIG. 2, an example fuel system 200 coupled to a high pressure direct injection system is schematically shown. In one example, fuel system 200 is an example embodiment of fuel system 80 coupled to direct injector 66A of FIG. 1.

Fuel system 200 includes fuel tank 210, shown with a first fuel pump 212, which may be mounted internal, adjacent, or external to the fuel tank. The first fuel pump 212 may be referred to as a low pressure pump that increases fuel pressure to approximately 4 bar. Pressurized fuel exits the first pump 212 and is delivered to a second fuel pump 214, which may be referred to as a high pressure pump that increases fuel pressure to approximately 50-150 bar, depending on operating conditions. In one example, the second fuel pump 214 may have an adjustable pump stroke that may be adjusted by controller 12 to vary the increase in fuel pressure generated depending on operating conditions.

Continuing with FIG. 2, the second fuel pump 214 delivers further pressurized fuel to a high pressure fuel rail 216, which then distributes the fuel to a plurality of direct fuel injectors 218, each of which may be coupled to a distinct cylinder. For example, one of the plurality of direct injectors may be injector 66A coupled to cylinder 30 in FIG. 1. A fuel rail pressure sensor 220 is also shown coupled to the high pressure fuel rail for estimating a pressure therein.

An engine controller 12 may be configured to command a direct injector 218 open to directly inject fuel into the corresponding cylinder. For example, the amount of high pressure fuel injected into a cylinder may be based on a pulse-width signal commanded to the corresponding direct injector 218. As discussed earlier, based on a timing of manual transmission clutch application, an engine may become compression locked during engine cranking, resulting in an unsuccessful engine start attempt. A subsequent engine start may not be attempted until the compression pressure in the engine is reduced. As elaborated at FIG. 3, direct injector operation may be used to relieve the compression pressure and mitigate the compression locking. For example, responsive to an aborted engine start due to compression locking, the controller 12 may command the direct injector 218 coupled to a selected cylinder, such as the last cylinder to have fired, so that the compression pressure can be relived into high pressure fuel rail 216. Once the pressure is relieved, engine cranking can be resumed. The air from the pressurized cylinder will dissolve into the fuel rail and may be expelled over a plurality of subsequent injection events.

Note that while FIG. 2 shows various direct connections, such as between the first and second pumps, various additional valves, filters, and/or other devices may be intermediately connected, yet still enable the first and second pumps to be coupled.

In this way, the components of FIGS. 1-2 may enable a vehicle system comprising an engine; a fuel system including a high pressure fuel pump, a fuel rail, and a plurality of direct fuel injectors coupled to the fuel rail, each of the plurality of direct fuel injectors coupled to a corresponding engine cylinder; a manual transmission including a clutch actuated by an operator foot pedal; a starter motor; a crankshaft position sensor coupled to a crankshaft of the engine; and a controller with computer readable instructions stored on non-transitory memory for: during an engine start, cranking the engine via the starter motor until a threshold speed is reached; then resuming spark and fuel delivery into a first cylinder selected based on piston position; actuating the clutch based on operator input; indicating compression locking of the engine during the engine start based on an output of the sensor; and responsive to the indication of compression locking, commanding one of the plurality of direct injectors coupled to the first cylinder open for a duration before attempting a subsequent engine start. As an example, indicating compression locking of the engine during the engine start based on the output of the sensor includes indicating compression locking responsive to an initial change in sensor output during the cranking, following by no change in the sensor output following the resuming of spark and fuel delivery into the first cylinder. The duration of commanding the direct injector of the first cylinder open may be based on the voltage or state of charge of a battery coupled to the starter motor. The battery voltage during the compression locking may indicate how much energy the starter motor has to overcome the in-cylinder pressure. More pressure must be relieved if the battery voltage is lower. The duration may be adjusted to provide a target DI flow rate, the target flow rate of the DI injector based on the DI injector orifice size and delta pressure across the injector (that is, the difference between fuel rail pressure and inferred cylinder pressure based on cylinder volume, compression ratio, and air charge). Further, during the subsequent engine start, the controller may extend the duration of direct fuel injection for a number of combustion events since a first combustion event. The number of combustion events may be based on an amount of air ingested during the commanding the direct injector open.

Figure 3:
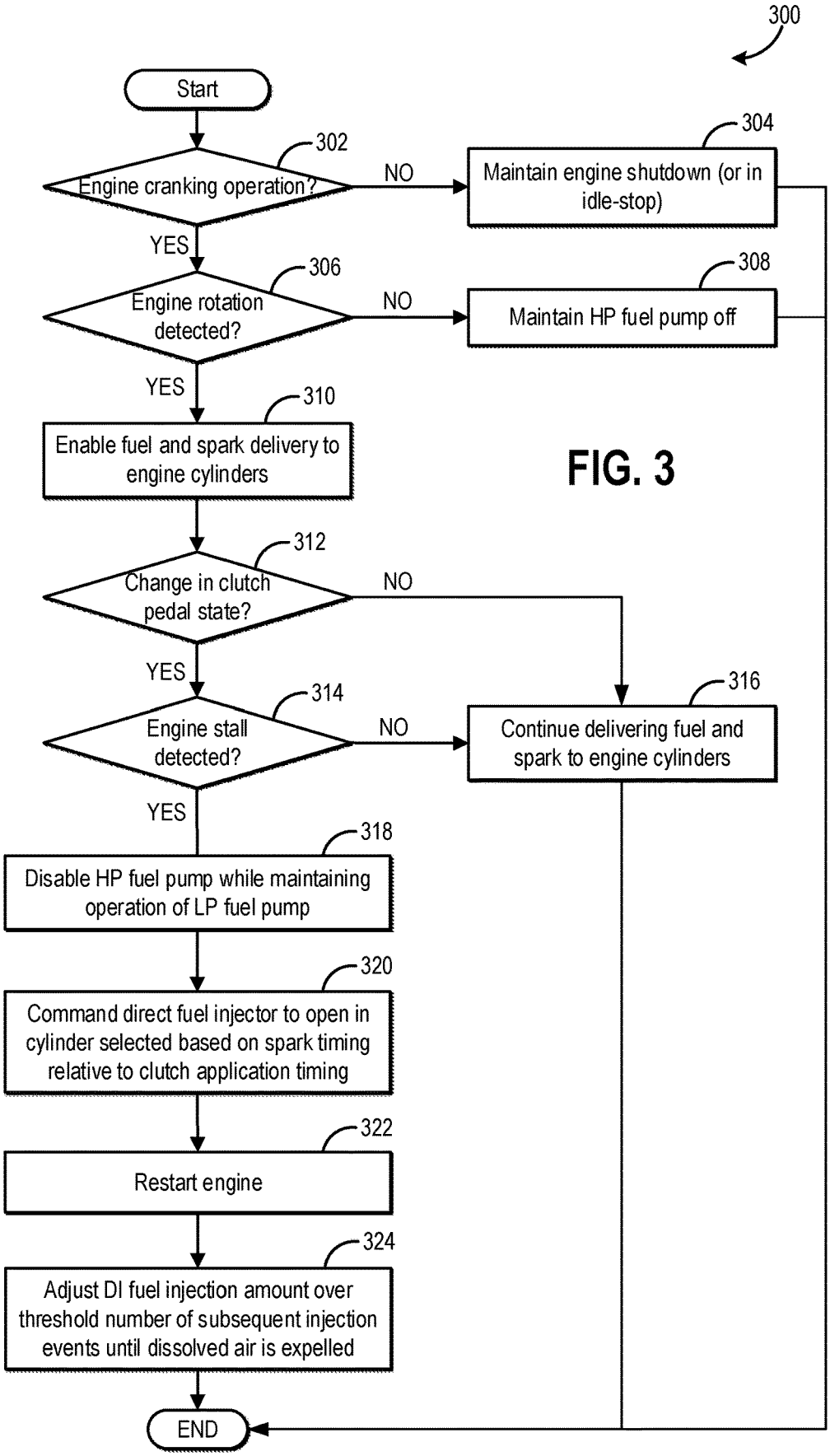
FIG. 3 shows a high level flowchart of an example control system operation.
Figure 4:
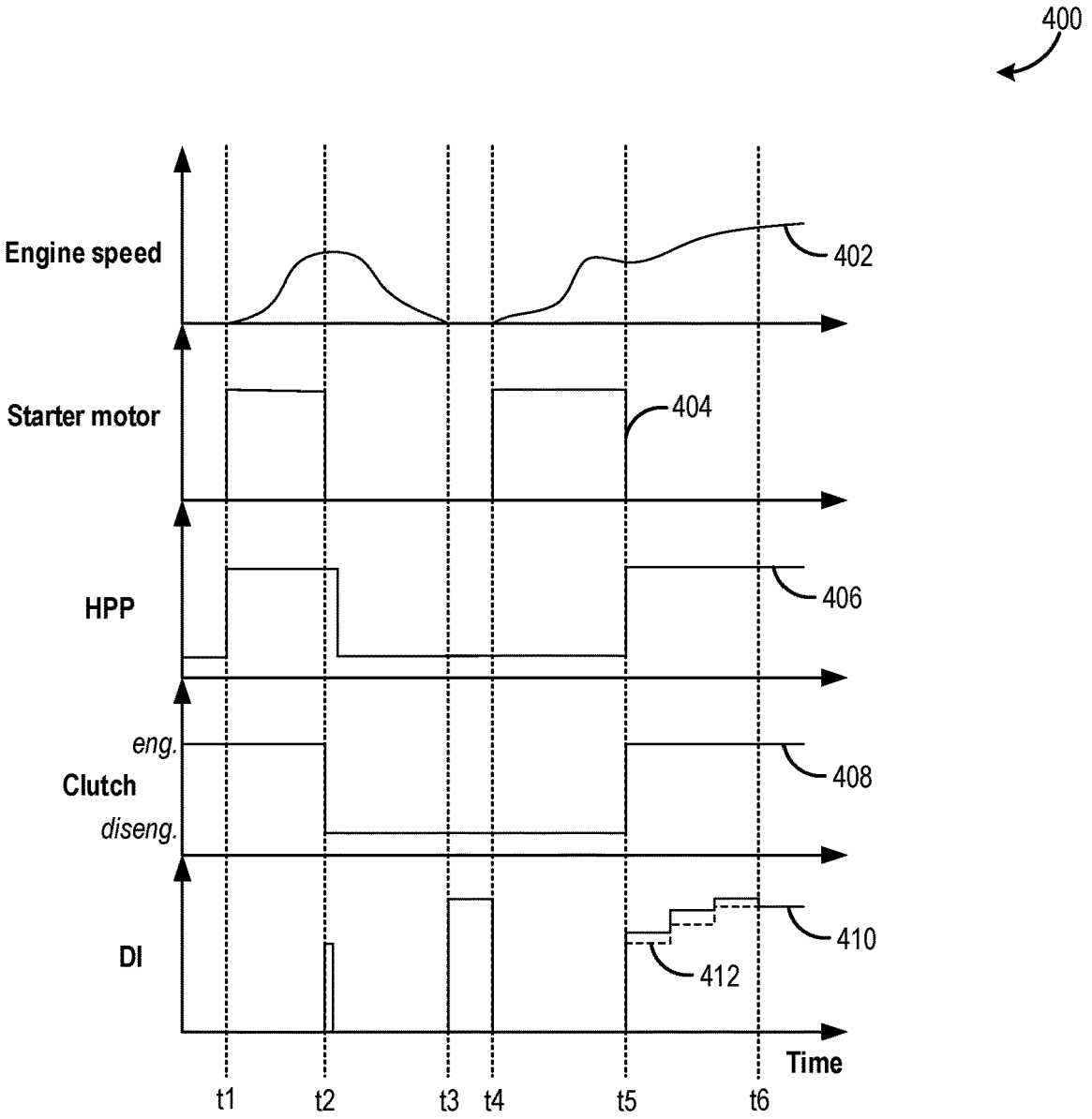
FIG. 4 shows a prophetic example of unlocking a compression locked engine using a direct fuel injector.

Referring now to FIG. 3, an example method 300 is shown for relieving compression pressure due to engine locking during an engine starting operation. Instructions for carrying out method 300 and the rest of the methods included herein may be executed by a controller based on instructions stored on a memory of the controller and in conjunction with signals received from sensors of the engine system, such as the sensors described above with reference to FIGS. 1-2. The controller may employ engine actuators of the engine system to adjust engine operation, according to the methods described below.

At 302, the method includes determining whether the engine is cranking. For example, the routine may monitor whether a starter motor is engaged, or whether another related motor, such as in a hybrid powertrain, is rotating the engine to start engine combustion operation. In one example, the engine cranking may be initiated responsive to an operator request to start the engine such as by inserting a key into the ignition slot, by actuating an engine start/stop button to a start position, by placing a passive key (or key fob) inside the vehicle, or by requesting an engine start remotely via the key fob, a smart phone, a tablet, or other smart device communicatively coupled to the vehicle's controller. In still another example, where the engine is configured with idle-stop capabilities, the engine cranking may be initiated responsive to an engine restart condition being met without receiving input from the operator.

Restart conditions may be considered met if a battery state of charge is below a threshold (e.g., less than 30%), a request for air-conditioner compressor operation is received, engine temperature (for example, as inferred from an engine coolant temperature) is below a threshold temperature (such as a catalyst light-off temperature), a throttle opening degree is more than a threshold, driver requested torque is more than a predetermined threshold value, brake pedal has been released, etc. If any or all of the restart conditions are met, then the engine may be cranked to resume fuel combustion in engine cylinders.

If the engine is not cranking, at 304, the engine may be maintained shutdown with cylinders not combusting fuel and the engine at rest. If engine cranking is confirmed, then at 306, the method includes determining whether engine rotation has been detected. In one example, engine rotation may be detected via a CPS signal from a crankshaft position sensor (such as based on a missing tooth of wheel 119 of FIG. 1). If engine cranking is not confirmed, then at 304, the method includes maintaining the engine shutdown, or in idle-stop, with no fuel being delivered to engine cylinders and no cylinder combustion being carried out.

If an engine cranking operation is confirmed, then at 304, it may be determined if engine rotation has been detected. In one example, engine rotation may be detected via a CPS signal (which may be based on a missing tooth of wheel 136 of FIG. 1). As another example, engine rotation may be confirmed if the engine speed starts to rise from its initial state of rest (zero speed) and the engine speed remains positive while steadily increasing. If engine rotation is not detected, such as when the engine speed remains at zero, then at 306, the method includes maintaining fuel pumps disabled. For example, the high pressure fuel pump may be maintained disabled while the low pressure pump may be enabled (in anticipation of resuming fuel injection). This operation may effectively limit the fuel rail pressure to the pressure of the in-tank system (e.g., 4 bar). The engine start is not aborted responsive to no engine rotation being detected. Instead, the DI injector is commanded open while the starter motor is engaged to relieve the pressure and the engine may continue to spin again once the pressure is relieved and the starter has enough energy. If the engine does not rotate during the calibratable amount of time allowed to start the engine, then the start is aborted.

If engine rotation is detected, at 310, fuel and spark delivery to engine cylinders may be enabled. For example, both the low pressure and the high pressure pumps may be enabled, raising the fuel rail pressure. In addition, spark delivery may be enabled. While fuel and spark are enabled, fuel and spark may only be actually delivered to engine cylinders after a threshold cranking speed has been surpassed. For example, the engine may be cranked via the starter motor until the engine reaches a position where fuel is scheduled, and then the fuel injector is commanded open. Likewise, spark delivery is resumed once the engine is cranked to a scheduled position.

If engine rotation is detected after cranking the engine, at 312, it may be determined if there is a change in clutch pedal state. For example, the engine may be coupled to a manual transmission wherein a clutch pedal state is adjusted by an operator by actuation a foot pedal and/or a gear selector. The controller may determine if the vehicle operator has disengaged the clutch so as to move the vehicle before the engine has completed the starting process. In one example, a change in the clutch pedal state may be inferred or sensed based on a clutch pedal position sensor.

If there is no change in clutch pedal state, then at 316, after engine rotation has been initiated, delivery of fuel and spark to the engine cylinders is continued. Herein, since there is change in the clutch pedal state during the cranking, an engine stall is not anticipated. The controller may deliver fuel and spark to the rotating engine once the cranking speed is exceeded after which engine rotation can be provided via fuel combustion in the engine cylinders.

If there is a change in clutch pedal state, then at 314, it may be determined if an engine stall has been detected (or is predicted). An engine stall may be confirmed responsive to an initial increase in engine speed following the cranking, and then a sudden drop in engine speed towards rest. An engine stall may occur based on a timing of clutch actuation by the operator relative to spark timing in a first cylinder to fire. Typically, spark maybe scheduled in a given cylinder ~10-15 degrees before the cylinder piston reaches top dead center (of a compression stroke). If the operator disengages the clutch at the moment of spark delivery, the torque produced by the firing cylinder is not capable of producing sufficient torque to propel the vehicle. As a result, the combustion pressure can force the engine to rotate backward. In addition, the compression pressure is trapped inside the cylinder that just fired. Since the starter motor is not designed to overcome this large pressure, the engine may stall. In addition, the engine may become compression locked until the pressure leaks past the cylinder rings. An engine start may only be reattempted after the pressure has been relieved. If an engine stall is not confirmed, then the method returns to 316 to continue delivering fuel and spark to the engine cylinders.

If an engine stall is detected, then at 318, the method includes disabling the high pressure fuel pump while maintaining the low pressure pump on. At 320, the method includes commanding the direct injector of an engine cylinder to open so as to relieve the compression pressure built up in the cylinder, and thereby unlock the compression locked engine. The cylinder whose direct fuel injector is commanded open may be selected based on spark timing of the cylinder relative to the clutch application timing. For example, the cylinder that was the last cylinder to fire before the clutch application, or which has a spark timing closest to, and before, the clutch application timing, may be selected. As such, this is the cylinder that is still before TDC at the time of the clutch application.

Commanding the direct injector open may include the controller sending a pulse-width signal to the direct injector of the selected cylinder. The pulse-width signal may be default signal. Alternatively, the pulse-width signal may be based on battery voltage during the engine start. The battery voltage during the compression locking indicates how much energy the starter has to overcome the in-cylinder pressure. More pressure must be relieved if the battery voltage is lower. The flow rate of the DI injector is based on the DI injector orifice size and delta pressure across the injector (difference between fuel rail pressure and inferred cylinder pressure which is based on cylinder volume, compression ratio, and air charge). As a result of commanding the direct injector to open, the cylinder compression pressure is relieved into the high pressure fuel rail. In particular, since the direct injector is fluidly coupled to the fuel rail, the air from the cylinder is released into the high pressure fuel rail where it dissolves into the fuel in the fuel rail. This air is then expelled from the fuel rail over the next several injection events.

At 322, the method includes restarting the engine. For example, engine cranking may be reattempted via a starter motor and then spark and fuel delivery to the engine may be resumed once a cranking speed threshold is exceeded. By relieving the compression pressure from the locked engine into the fuel rail via the direct injector, the engine is rapidly unlocked and the subsequent engine start can be reattempted soon after. By reducing delays in being able to restart the engine, operator frustration is reduced.

At 324, after the engine is successfully restarted, the method includes adjusting the DI fuel injection amount over a threshold number of subsequent injection events until the dissolved air is sufficiently expelled. For example, over each of a plurality of direct injection events following the engine start, the direct injector may be held open longer so as to deliver a given amount of fuel. Herein, the additional duration over which the direct injector is held open compensates for the presence of added air in the fuel in the fuel rail. In one example, the direct injector is held open longer by extending the pulse-width signal. On each event, the added duration may be a predetermined amount, such as a predetermined percentage of an initially determined pulse-width. Further, the number of injection events over which the pulse-width adjustment is performed may be based on the amount of air ingested during the commanding the DI open. The amount of air ingested may be based on the delta pressure between initial fuel rail pressure and the final fuel rail pressure (that is, the increase of fuel rail pressure due to relieving the in-cylinder pressure by opening the DI). The controller may increase the DI pulse width by ratio of ingested air volume over existing fuel rail volume. The number of injections is then based on accumulating the amount of fuel volume injected until the entire contaminated fuel rail volume is injected.

However, in other examples, a default fuel mass strategy may be used for subsequent engine starts. For example, all the in cylinder pressure of the compression locked engine may be relieved in one DI even. Thereafter, subsequent start attempts may use the normal fuel mass strategy unless a locking event is detected again.

In this way, existing hardware may be used to rapidly relieve combustion pressure during engine compression locking. As a result, a subsequent engine start can be attempted soon after an initial unsuccessful engine start.

Turning now to FIG. 4, a prophetic example of relieving compression pressure via a direct injector opening is shown. Map 400 depicts engine speed at plot 402, starter motor operation at plot 404, operation of a high pressure fuel pump (HPP) at plot 406, engagement state of a transmission clutch at plot 408, and a direct injector command at plot 410. All plots are shown over time along the x-axis.

Prior to t1, the engine is shut down with fueling and spark disabled and engine at rest (plot 402). At t1, responsive to an operator request for vehicle operation, the engine is started. Therein, a starter motor is enabled (plot 404) to crank the engine resulting in an increase in engine speed (plot 402). Between t1 and t2, the engine speed starts to increase with positive engine rotation via the starter motor. At t2, a cranking speed threshold is surpassed and engine fueling is resumed. In particular, spark and fuel (via direct injection, as shown at plot 410) are delivered to a first cylinder at t2 to initiate cylinder combustion. Starter motor operation is disabled while fueling is enabled.

Also at (or around) t2, the operator actuates a clutch pedal to disengage a transmission clutch. Due to the timing of the clutch actuation relative to spark timing in the first cylinder, insufficient torque is produced in the combusting cylinder. This results in an engine reversal and compression pressure builds up in the first cylinder. The engine starts spinning down to rest. The engine start is aborted and the HPP is disabled.

To relieve the compression pressure built up in the first cylinder and enable an engine start to be reattempted, at t3, after the engine has spun to rest, the direct injector of the first cylinder is commanded open. For example, a highest possible duty cycle is commanded to the direct injector. With the HPP disabled, the opening of the direct injector results in the compression pressure trapped in the cylinder being rapidly expelled into the high pressure fuel rail. As such, this unlocks the compression locked engine rapidly and enables an engine start to be reattempted at t4.

At t4, as at t1, the starter motor is enabled to crank the engine resulting in an increase in engine speed. At t5, the cranking speed threshold is surpassed and engine fueling is resumed. In particular, spark and fuel (via direct injection) are delivered to a second cylinder at t5 to initiate cylinder combustion. Starter motor operation is disabled while fueling is enabled. Since there is no change in clutch pedal state, engine compression locking does not occur and a successful engine start is accomplished.

To compensate for the presence of dissolved air in the fuel rail, between t5 and t6, for a number of fuel injection events since a first combustion event following the engine cranking, the DI fuel pulse is adjusted. In particular, a larger than required DI fuel pulse is commanded on each combustion event. In the depicted example, the desired DI fueling based on engine speed-load is shown by dashed line 412. Between t5 and t6, a larger amount of DI fueling is provided (see difference between desired amount shown by dashed line 412 and actual amount shown by solid line 410). At t6, substantially all the dissolved air is expelled from the fuel rail. Therefore after t6, DI fueling is provided based on engine speed-load and without compensating for dissolved air.

In this way, engine compression locking during an engine start can be mitigated rapidly, enabling a subsequent engine start to be attempted earlier. The technical effect of commanding a direct injector open responsive to compression locking is that combustion pressure trapped in an engine cylinder can be rapidly relieved into the high pressure fuel rail. By commanding open a direct injector coupled to a cylinder that fired around the same time as a clutch state was changed, the cylinder with the combustion pressure trapped therein can be relieved. By expediting pressure relief to enable a subsequent engine start attempt, operator frustration due to delays in engine starting is reduced. Overall, performance of an engine configured with a manual transmission is improved.

One example method for a vehicle comprises: cranking an engine; and responsive to engine locking following the cranking, commanding a direct fuel injector of a cylinder open to relieve cylinder pressure into a high pressure fuel rail via the open direct fuel injector. In the preceding example, additionally or optionally, the engine is cranked via a motor, and the engine locking is responsive to operator actuation of a vehicle clutch during a first combustion event following the cranking. In any or all of the preceding examples, additionally or optionally, the method further comprises selecting the cylinder based on spark timing relative to a timing of clutch actuation. In any or all of the preceding examples, additionally or optionally, the selecting includes selecting the cylinder having the spark timing at or within a threshold distance before the timing of clutch actuation. In any or all of the preceding examples, additionally or optionally, a piston of the selected cylinder is at or before compression stroke top dead center. In any or all of the preceding examples, additionally or optionally, the method further comprises indicating the engine locking based on detection of engine rotation during the cranking followed by termination of the engine rotation following the operator actuation of the vehicle clutch. In any or all of the preceding examples, additionally or optionally, the first combustion event includes delivery of fuel and spark to a first cylinder, and wherein commanding the direct fuel injector to open includes commanding the direct fuel injector of the first cylinder to open. In any or all of the preceding examples, additionally or optionally, the vehicle clutch is coupled to a manual transmission of the vehicle. In any or all of the preceding examples, additionally or optionally, the cranking is responsive to one of an operator engine start request and an engine idle-stop condition being met. In any or all of the preceding examples, additionally or optionally, the method further comprises during a subsequent engine start, increasing a direct injection pulse-width commanded for a number of combustion events following engine cranking.

Another example method comprises: during an engine start, applying a transmission clutch responsive to operator input; indicating engine compression locking based on rise in engine speed during engine cranking via a motor followed by drop in the engine speed after a first combustion event of the engine; and responsive to the compression locking, commanding a direct injector of a cylinder open. In the preceding example, additionally or optionally, the method further comprises selecting the cylinder based on spark timing of the first combustion event relative to timing of applying the transmission clutch. In any or all of the preceding examples, additionally or optionally, the spark timing of the selected cylinder is at or before the timing of applying the transmission clutch. In any or all of the preceding examples, additionally or optionally, a duration of commanding the direct injector of the cylinder open is based on state of charge of a battery coupled to the starter motor, the duration increased as the state of charge decreases. In any or all of the preceding examples, additionally or optionally, the method further comprises, after commanding the direct injector open, restarting the engine, and for a number of combustion events from a first combustion event of the restarting, increasing a direct injection pulse-width command relative to a default pulse-width command based on engine speed and load, the increasing determined as a function of a measured increase in fuel rail pressure from commanding the direct injector open.

Another example vehicle system comprises: an engine; a fuel system including a high pressure fuel pump, a fuel rail, and a plurality of direct fuel injectors coupled to the fuel rail, each of the plurality of direct fuel injectors coupled to a corresponding engine cylinder; a manual transmission including a clutch actuated by an operator foot pedal; a starter motor driven by a battery; a crankshaft position sensor coupled to a crankshaft of the engine; and a controller with computer readable instructions stored on non-transitory memory for: during an engine start, cranking the engine via the starter motor until a threshold speed is reached; then resuming spark and fuel delivery into a first cylinder selected based on piston position; actuating the clutch based on operator input; indicating compression locking of the engine during the engine start based on an output of the sensor; and responsive to the indication of compression locking, commanding one of the plurality of direct injectors coupled to the first cylinder open for a duration before attempting a subsequent engine start. In the preceding example, additionally or optionally, the indicating compression locking of the engine during the engine start is based on the output of the sensor includes indicating compression locking responsive to an initial change in sensor output during the cranking, following by no change in the sensor output following the resuming of spark and fuel delivery into the first cylinder. In any or all of the preceding examples, additionally or optionally, the duration of commanding the direct injector of the first cylinder open is based on voltage of the battery during the cranking, the duration increased as the voltage decreases. In any or all of the preceding examples, additionally or optionally, the duration of commanding the direct injector open is further adjusted based on a target direct injector flow rate determined as a function of direct injector orifice size and delta pressure across the direct injector. In any or all of the preceding examples, additionally or optionally, the controller includes further instructions for, during the subsequent engine start, extending the duration of direct fuel injection for a number of combustion events since a first combustion event.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for controlling a direct fuel injector of an engine, comprising:

during an engine start and via an electronic controller, responsive to a transmission clutch being applied;

determining engine compression locking based on a rise in engine speed during engine cranking via a motor followed by a drop in the engine speed after a first combustion event of the engine start; and responsive to determination of the compression locking, commanding the direct injector of a cylinder of the engine open.

2. The method of claim 1, further comprising selecting, via the electronic controller, the cylinder based on a comparison of commanded spark timing of the first combustion event relative to timing of applying the transmission clutch.

3. The method of claim 2, wherein the spark commanded timing of the selected cylinder is concurrent with an application of the transmission clutch or before application of the transmission clutch.

4. The method of claim 1, wherein a duration for which the direct injector of the cylinder is commanded open is based on a state of charge of a battery coupled to the motor, the duration increased as the state of charge decreases, the state of charge determined by the electronic controller based on battery operating conditions.

5. The method of claim 1, further comprising, after commanding the direct injector open, restarting the engine, and, for a number of combustion events from a first combustion event of the restarting, increasing a direct injection pulse-width command relative to a default pulse-width command based on engine speed and load, the increasing determined as a function of a measured increase in fuel rail pressure from commanding the direct injector open.

6. The method of claim 1, wherein the first combustion event includes delivery of fuel and spark to a first cylinder, and wherein commanding the direct fuel injector to open includes commanding the direct fuel injector of the first cylinder to open.

7. The method of claim 1, wherein a piston of the selected cylinder is at or before compression stroke top dead center.

* * * * *